United States Patent [19]

Brocklehurst

[11] Patent Number: 4,856,442

[45] Date of Patent: Aug. 15, 1989

[54] FITTED SHEET HEMMER

[75] Inventor: Charles E. Brocklehurst, Fountain Inn, S.C.

[73] Assignee: Sew Simple Systems, Inc., Fountain Inn, S.C.

[21] Appl. No.: 260,381

[22] Filed: Oct. 20, 1988

Related U.S. Application Data

[60] Continuation-in-part of Ser. No. 248,790, Sep. 28, 1988, which is a division of Ser. No. 111,915, Oct. 21, 1987, Pat. No. 4,773,341.

[51] Int. Cl.[4] ..... D05B 35/02

[52] U.S. Cl. ..... 112/147; 112/304; 112/2; 112/10; 493/408; 493/423; 493/441

[58] Field of Search ..... 112/147, 141, 153, 152, 112/138, 136, 50, 51, 10, 2, 121.15, 121.12, 304; 493/408, 423, 441, 459

[56] References Cited

U.S. PATENT DOCUMENTS

| | | | |
|---|---|---|---|
| 2,694,372 | 11/1954 | Hadfield | 112/10 X |
| 2,900,934 | 8/1959 | Judelson | 112/10 X |
| 4,499,834 | 2/1985 | Ruetschle et al. | 112/147 X |
| 4,570,557 | 2/1986 | Freermann | 112/147 |
| 4,594,956 | 6/1986 | Vartoukian et al. | 112/121.15 X |
| 4,648,336 | 3/1987 | Ragnebring | 112/147 |
| 4,742,788 | 5/1988 | Dugan | 112/10 X |

*Primary Examiner*—H. Hampton Hunter
*Attorney, Agent, or Firm*—Thomas & Kennedy

[57] ABSTRACT

Sheet material (30) is cut into rectangular segments (35). The segments are then moved in sequence parallel to their cut edges (26) rapidly away from the cutting station (34) into a slower operating first sewing station (40) where elastic bands (20, 21) are sewn to the cut head and foot edge portions (26, 27) of the segments. The rapidly moving trailing portion of each segment (35) of sheet material is temporarily accumulated at the accumulation station (39) and progressively fed at a lower rate from the accumulation station to the first sewing station (40). The head and foot edge portions (26, 27) of each segment are folded into overlying relationship with respect to the main body portion by passing the main body portion through a U-shaped turn (49) and at the same time passing the head and foot edge portions through a pair of reverse 90 degree turns (50 and 53). Sewing machines (164, 165) are moved inwardly and then outwardly across the folded edge portions of the segment, thus forming the sewn line of chain stitching (25) diagonally across the corners of the bedsheet (10).

2 Claims, 4 Drawing Sheets

FITTED SHEET HEMMER

CROSS REFERENCE

This is a continuation-in-part of U.S. patent application Ser. No. 248,790 filed Sept. 28, 1988, which is a division of U.S. patent application No. 111,915 filed Oct. 21, 1987, now U.S. Pat. No. 4,773,341 issued Sept. 27, 1988.

FIELD OF INVENTION

The invention disclosed herein generally relates to a system of forming fitted bed sheets of the type that have a rectangular portion which covers the top surface of a bed mattress and have formed side skirts and head and foot skirts which extend about the side surfaces of the mattress and inwardly beneath the mattress More particularly, the invention relates to the steps of applying elastic banding to the opposite side edges, folding the side edge portions into overlying relationship with the segment, and then stitching diagonally across the folded corners to form the corners of the fitted bed sheet.

BACKGROUND OF THE INVENTION

Fitted bedsheets which are applied in form-fitting relationship with respect to a bed mattress usually include elastic bands extending along the edges of the head and foot portions of the skirt of the bedsheet or along the edges of the side portions of the skirt of the bedsheet which draw the skirt of the sheet tight about the bed mattress.

The usual prior art procedure for sewing the corner structures and for applying the elastic bands to fitted bed sheets comprises manual handling of the segments of sheet material as the sewing steps are performed. Typically, the elastic bands are stretched and sewn to the cut head and foot edge portions of the segments of sheet material. The side edge portions or the head and foot edge portions can be folded over into overlying relationship with the segment and then a diagonal line stitch formed at all four corners of the segment of sheet material, thereby completing the fitted bed sheet. One of the more expensive aspects of the fabrication of fitted sheets is the manual handling of the bed sheet after it has been cut from a supply and as it is sewn by the operator in a sewing machine. The operator must manipulate the large segments of sheet material when performing the sewing functions.

SUMMARY OF THE INVENTION

Briefly described, the present invention comprises an automated system for continually forming fitted bed sheets from a supply of sheet material, whereby the sheet material is advanced along its length from a supply to a cutting station and cut so as to form cut segments of the sheet material. The sheet material is then advanced in a processing path parallel to its cut edges, and its cut edges later become the head and foot edges of the finished bed sheet or the side edges of the finished bed sheet, depending on how the system is set up. For the purposes of describing this invention, the cut edges of the segments of sheet material will be considered as the head and foot edges. Elastic banding is sewn to the head and foot edge portions, the head and foot edge portions are then folded into overlying relationship with respect to the main body of the segment of sheet material thus forming the head and foot skirts of the bed sheet, and then a line stitching is formed diagonally across each of the four corners of the segment of sheet material, through the head and foot skirts and through the adjacent overlying portions of the segment of sheet material, which completes the formation of the fitted bed sheet.

In order that the system work progressively and expediently, an infeed conveyor rapidly transfers the previously cut segments of sheet material out of the cutting station towards the first sewing station. When the leading edge of the on-coming segment of sheet material reaches the sewing station, the leading edge begins to travel at the rate of slower operation of the sewing machines in the sewing station, while the on-coming trailing portion of the segment of sheet material continues to move more rapidly. A recess is formed in the work table so as to temporarily accumulate the on-coming rapidly moving trailing portion of the sheet material, so that the trailing portion can be moved out of the cutting station, out of the way of the next-to-be-cut segment of sheet material.

The elastic band material to be applied to the head and foot edge portions of the segments of sheet material is continuously fed through sewing heads at each side of the processing path so that the elastic bands are continuously sewn to the cut head and foot edge portions, with the band material spanning the gaps between adjacent segments of sheet material.

The infeed conveyor is movable vertically toward and away from the worktable so that when the infeed conveyor is raised away from the work table the leading edge of the supply of sheet material can travel across the processing path between the work table and the infeed conveyor to reach its cut position, whereupon the cut is formed across the supply of sheet material and the conveyor is lowered down into engagement with the segment of sheet material. This enables the conveyor to make positive contact with the cut segment of sheet material as the segment begins its movement along the processing path.

In order to continually form the head and foot skirts of the fitted bedsheet, the central portion of each segment of sheet material is moved through a U-turn and the head and foot edge portions are each moved through a first right angle turn as the central portion approaches the U-turn and through a second right angle turn as the central portion moves away from the U-turn. This forms the head and foot edge portions parallel to and in overlying relationship with respect to the central portion of the segment of sheet material, thereby completing the folding over of the head and foot skirts.

The length of the U-turn travelled by the central portion of the segment of sheet material can be changed with respect to the lengths of the two right angle turns followed by the head and foot edge portions so as to adjust the alignment of the leading and trailing edges of the head and foot edge portions with respect to the leading and trailing edges of the main body of the segment of sheet material.

After the folds have been formed in the segments of sheet material, right and left hand sewing machines form a sewn line of chain stitching at a diagonal across each of the four corners of the head and foot skirts, thereby completing the fitted bedsheet. The corner stitching formed at the trailing edges of the segments of sheet material are spaced a predetermined distance from the corner stitching at the leading edges of the segments, without regard to the length of the segments.

This causes the segments to be properly formed as fitted sheets to fit standard sized mattresses even when the segments are too long or too short.

Thus, it is an object of this invention to provide a method and apparatus for continually, accurately and automatically forming fitted bedsheets from a supply of sheet material, whereby the supply of sheet material is cut into segments and the segments are continuously and automatically processed until the final product is formed.

Another object of this invention is to provide a rapid conveyor transfer system which moves a previously cut segment of sheet material rapidly away from a cutting station so as to make room for the next sheet-cutting operation while feeding the leading edge of the previously cut segment into a slower operating sewing station and accumulating the intermediate and trailing portion of the segment of sheet material so as to not overrun the sewing operation.

Another object of this invention is to provide a continuously operating, automated folding system which receives a series of cut segments of sheet material and progressively folds the side edges of the segments into accurately aligned overlying relationship with respect to the central portion of each segment.

Another object of this invention is to provide a system for automatically sewing the corner structures of segments of sheet material after the edge portions have been folded over into overlying relationship with the central portion of the segments of sheet material so as to form fitted bedsheets.

Another object of this invention is to provide a fitted sheet hemmer that occupies a relatively small amount of floor space in a mill and which accurately and rapidly forms fitted bedsheets with a minimum of operator attention.

Other objects features and advantages of this invention will become apparent upon reading the following specifications, when taken in conjunction with the accompanying drawings.

DETAILED DESCRIPTION

Figure 1:
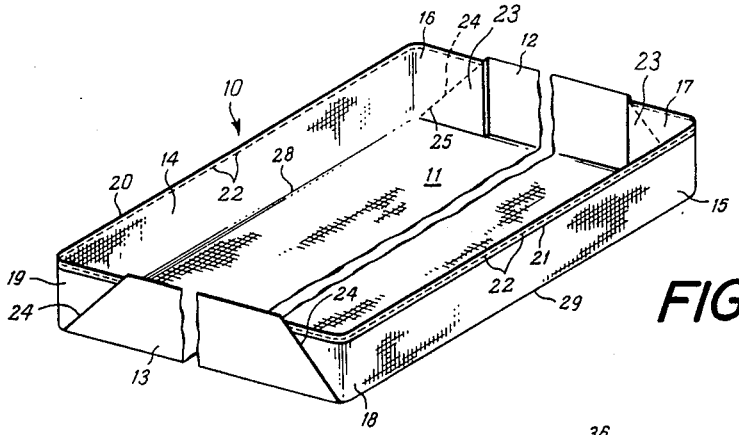
FIG. 1 is an inverted view of a completed fitted bedsheet, with the central portion of the sheet removed to reduce the size of the drawing.

Referring now in more detail to the drawings, in which like numerals indicate like parts throughout the several views, FIG. 1 illustrates a fitted bedsheet of a type that is to be mounted in form fitting relationship about a bed mattress. FIG. 1 illustrates the fitted bedsheet 10 in an inverted position, showing the main body portion 11 that is to cover the upper surface of the mattress, and side skirts 12 and 13 and head and foot skirts 14 and 15. Corner structures 16, 17, 18 and 19 are formed between the respective head, side, foot and side skirts. An elastic band 20 is attached along its length by stitching or similar connection means 22 to the free edge of head skirt 14, and a similar elastic band 21 is attached along its length to the free edge of foot skirt 15.

As best illustrated by corner structure 16, each corner structure is formed by the head or foot skirt 14 or 15 being turned at 90 degrees to begin the formation of the side skirt. The side skirt 12 or 13 is folded at a diagonal 24 and is sewn to head or footskirt 14 and 15 by a line of chain stitching 25. The chain stitching 25 extends over the end portions of the elastic bands 20 and 21 at each corner structure, and anchors the ends of the elastic bands 20 and 21 and the stitching 22 formed through the elastic bands at the free edges of the head and foot skirts 14 and 15. Optionally, the triangular folded portion 23 of the fitted sheet is cut away, as later disclosed.

Figure 2:
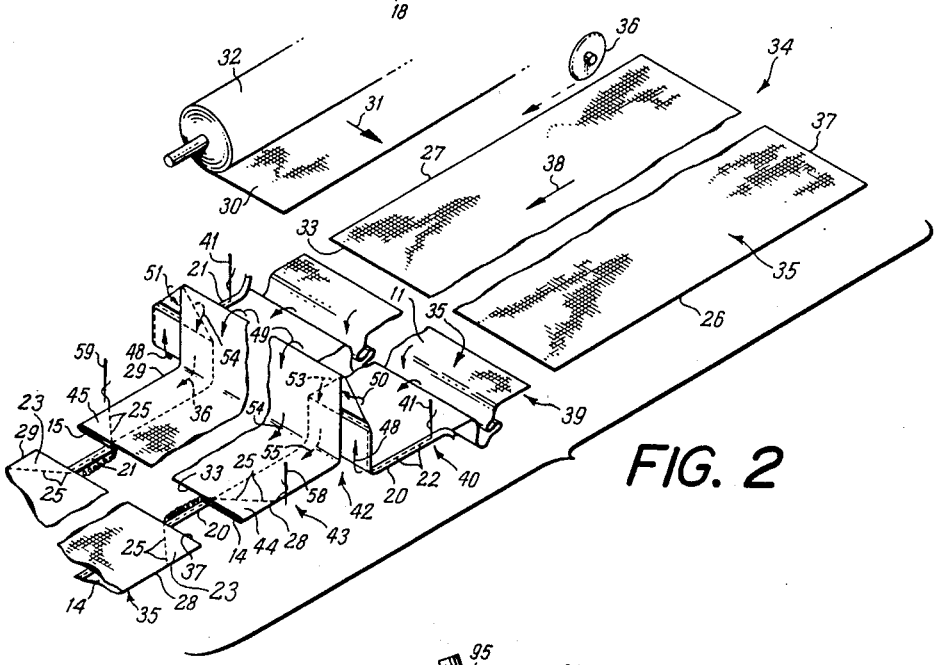
FIG. 2 is a progressive perspective illustration of portions of two segments of cut sheet material, showing the process of attaching elastic banding to the cut head and foot portions of the segments, folding the head and foot portions of the segments into overlying relationship with respect to the main body portion of each segment to form the head and foot skirts of the final bedsheet, and then sewing diagonal chain stitch across each of the four corners of the segment of sheet material to complete the fitted bed sheet.

As illustrated in FIG. 2, the fitted bedsheet 10 of FIG. 1 is formed by advancing sheet material 30 along its length as indicated by arrow 31 from a supply 32 to a cutting station 34. A segment 35 of the sheet material is cut from the supply by a conventional rotary cutter 36 that moves across and cuts through the sheet material. The segment 35 is then moved parallel to its cut edge in the direction indicated by arrow 38 into a temporary sheet accumulation station 39, then through a first sewing station 40 where the elastic bands 20 and 21 are sewn by needles 41 to the cut head and foot edge portions 26 and 27.

The sheet material continues to advance from the first sewing station 40 through the folding station 42 and then through the second sewing station 43. The head and foot edge portions 26 and 27 of each are folded at the folding station 42 into overlying relationship so as to form the head and foot skirts 14 and 15 which overlie the next adjacent edge portions 44 and 45 of the main body portion 11. The main body portion 11 as well as the head and foot edge portions 26 and 27 move through a 90 degree angle, from a horizontal direction of movement to a vertical direction of movement, as indicated by arrow 48. The main body portion 11 then moves through a 180 degree turn as indicated by arrows 49 so as to begin a downward movement. In the meantime, as the central body portion 11 approaches its U-turn, the head and foot edge portions 26 and 27 each progress through a 90 degree turn 50 and 51 so as to be turned laterally inwardly toward the main body portion 11. As the main body portion moves downwardly away from the U-turn the head and foot edge portions each turn through a second 90 degree turn 53 and 54 so as to begin a downward movement with the main body portion 11. This causes the head and foot edge portions 26 and 27 to become folded in overlying relationship with respect to the main body portion 11, thereby forming the head and foot skirts 14 and 15.

After the head and foot skirts 14 and 15 have been formed, the main body portion 11 and head and foot skirts 14 and 15 are turned through a 90 degree turn 54 so as to change directions from downward vertical movement into longitudinal horizontal movement, so that the segment can continue on through the processing path.

As the segment 35 of sheet material moves away from folding station 42 it enters the second sewing station 43. The needles 58 form the sewn line of chain stitching 25 at the trailing and leading corners of the folded segment of sheet material. The needles 58 and 59 of sewing machines positioned adjacent the side edges of the processing path of the segments of sheet material are positioned adjacent the folds 28 and 29 of the folded segment of sheet material, and as the trailing edge 60 of a segment 35 is detected by a photo cell, the needles 58 and 59 begin their sewing function and the sewing machines and their needles are carried inwardly from the folds 28 and 29. The combined motion of the needles moving inwardly from the folds 28 and 29 toward the main body portion 11 and of the movement of the segment of sheet material along the processing path results in a diagonal line of chain stitching 25 being formed across the trailing corners of the segments of sheet material.

When the sewing machines have completed their functions at the trailing edge of a segment 35, they will be in the proper position to begin their sewing function on the next on-coming segment 35 of sheet material. The needles 58 and 59 of the sewing machines will sew through the corner structures of the on-coming segment, and as the sewing function of the sewing machines begin, the sewing machines are moved outwardly with respect to the segment of sheet material. Again, the combined motion of the outward movement of the sewing machines together with the movement of the segment of sheet material through the processing path causes a diagonal line of chain stitching 25 to be formed across the corners of the segment of sheet material adjacent the on-coming edge of the segments. After the corners have been formed the elastic bands 20 and 21 will be cut by appropriate conventional cutters 60 from between adjacent ones of the segments 35 of sheet material. This completes the construction of the fitted bedsheet.

Figure 3:
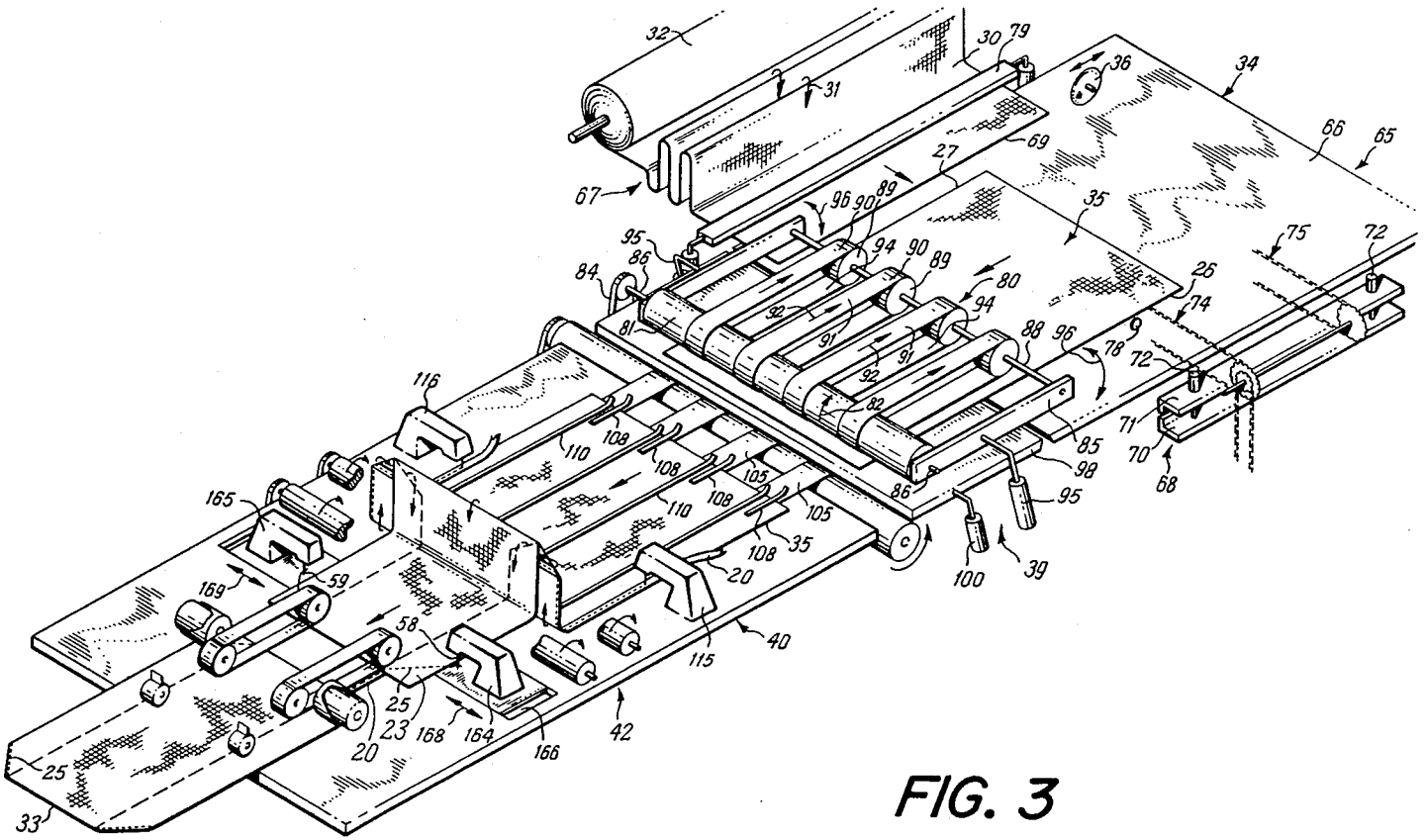
FIG. 3 is a perspective illustration of the fitted sheet hemmer, with the supporting framework and other portions of the apparatus removed for clarity.

As illustrated in FIG. 3, the fitted sheet hemmer 65 includes a work table 66 at the cutting station 34. Sheet material puller 68 is mounted above work table 66 and is arranged to travel across the work table and grasp the previously cut leading edge 69 of the sheet material 30 and pull the sheet material rapidly along its length from an accumulation feeder 67 into the cutting station 34. The sheet material puller includes a pair of grasping arms 70 and 71 that are movable toward and away from each other by pneumatic cylinders 72. The grasping arms 70 and 71 are suspended from conveyor chain assemblies 74 and 75 which move the grasping arms back and forth across the cutting station 34. The movement of the sheet material puller 68 and its grasping function are controlled by photo cells (not shown) strategically located at positions along the processing path. For example, photo cell 78 determines when the leading cut edge 69 of the supply of sheet material has been pulled the proper distance into the cutting station 34, whereupon the movement of the sheet material puller will be terminated, clamp 79 closed about the sheet and the operation of the rotary cutter 36 will begin so as to cut the segment 35 free from the supply of sheet material.

Infeed conveyor 80 is located over the processing path and overlaps cutting station 34. Infeed conveyor includes driven roll 81 which is rotated as indicated by arrow 82 by drive system 84. The supporting framework for driven roll 81 is not disclosed. The tilt frame 85 of the infeed conveyor 80 is mounted to the axle 86 at opposite ends of the driven roll 81, and the tilt frame supports moveable axle 88 which extends laterally across the processing path. A plurality of conveyor tape rollers 89 are mounted on the moveable axle 88, and conveyor tapes 90 extend about driven roll 81 and about a conveyor tape roller 89. When the driven roll 81 is rotated as indicated by arrow 82, the conveyor tapes 90 will move, with the upper flights 92 moving as indicated by arrows 92, and with the lower flights 94 moving in the opposite direction.

Fluid actuated cylinders 95 are mounted to the framework (not shown) and to the tilt frame 85 at opposite sides of the infeed conveyor 80 and function to tilt the infeed conveyor as indicated by arrows 96.

Figure 5:
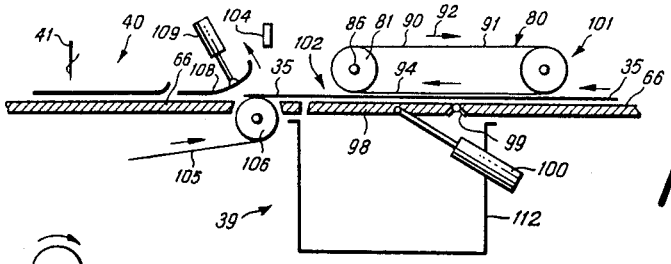
Figure 6:
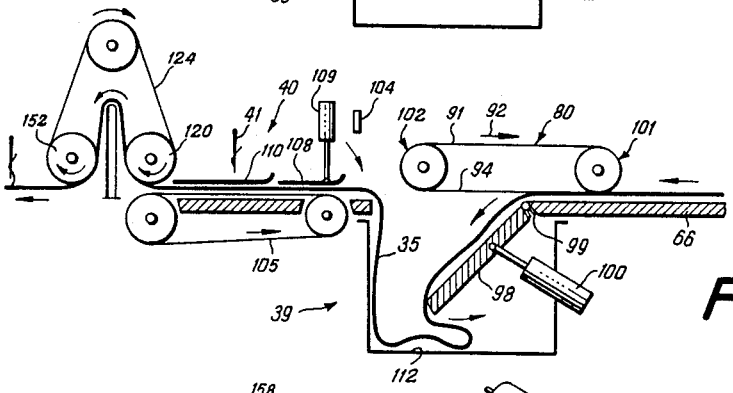

Work table 66 which extends from the cutting station 34 beneath the infeed conveyor 80 includes a moveable section 98 that is capable of moving downwardly away from the end feed conveyor 80. As illustrated in FIGS. 5 and 6, the moveable section 98 of the work table is hingedly supported at one end 99 and is movably supported by pneumatic cylinders 100 at opposite sides of the worktable. The cylinders 100 tilt the section 98 of the worktable toward and away from the infeed conveyor 80. It will be noted that the entrance end 101 of the infeed conveyor is positioned over the stationary portion of worktable 66, while the delivery end 102 is positioned over the moveable section 98 of the worktable.

Figure 4:
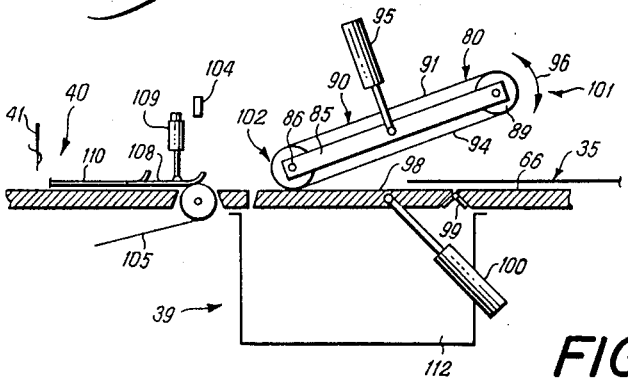
FIGS. 4, 5, and 6 are progressive illustrations of the infeed conveyor of the fitted sheet hemmer.

When the sheet material puller 68 (FIG. 3) is to be operated to travel over the worktable 66 and grasp the previously cut edge portion 69 of the sheet material 30 and then pull the sheet material out into the cutting station, the infeed conveyor 80 will be tilted to its up position (FIG. 4) to permit the passage beneath the infeed conveyor of the sheet material puller. When the sheet material puller has reached its home position and is out of the way of the infeed conveyor 80 the infeed conveyor will be tilted downwardly by its cylinders 95 so that its entrance end 101 is urged against the stationary portion of the worktable 66 (FIG. 5). In the meantime, the delivery end 102 of the infeed conveyor retains its position since the delivery end is mounted at the support axle 86.

When the segment of sheet material 35 has been properly drawn out and cut at cutting station 34 (FIG. 4), the infeed conveyor 80 will be moved from its raised position (FIG. 4) to its lowered position (FIG. 5) and its tapes set in motion by the rotation of driven roll 81. The lower flights of the conveyor tapes 90 engage and move the adjacent side edge portion of the segment 35, thereby pulling the entire segment in a stretched out, flat configuration across the worktable 66, across its moveable section 98 and into the first sewing station 40. The movements of the system are timed by a control system so that when the leading edge of the segment 35 has moved across the moveable section 98 of the work table into the sewing station 40, the cylinders 100 are actuated so as to drop the moveable section 98 of the worktable (FIG. 6). Also, a photo cell 104 (FIG. 5) can detect the presence of the segment, if desired.

In the meantime, the conveyor tapes 105 are driven by tape rolls 106 across the stationary portion of the worktable 66 and the leading edge of the segment of sheet material is advanced on to the conveyor tapes 105. Moveable presser feet 108 are positioned over each conveyor tape 105, and pneumatic cylinders 109 raise and lower the moveable presser feet. When the on-coming edge of the segment of sheet material is detected by the photo cell 104, the cylinders 109 are actuated to move the presser feet 108 downwardly into engagement with the segment 35, pressing the segment into positive relationship with the moving conveyor tapes 105, causing the leading portion of the segment to be positively carried through the first sewing station 40. Stationary presser feet 110 also assists in pressing the segment 35 of sheet material against the conveyor tapes, to make sure that the segment is positively carried on through the first sewing station.

The infeed conveyor 80 operates at a surface velocity that is 4 or 5 times faster than the feed velocity of the sewing stations. With this arrangement, the infeed conveyor will rapidly advance the segments 35 of sheet material out of the cutting station 34 so that the cycle of drawing out and cutting an additional segment of sheet material can be accomplished very soon after the previously cut segment has been formed. In the meantime, the previously cut moving segment of sheet material will not be allowed to overrun the sewing station 40 because of the downward movement of the section 98 of the worktable which permits the rapidly moving trailing portion of the segment 35 of sheet material to fall downwardly into an accumulation bin 112 located beneath moveable section 98 at the temporary sheet accumulation station 39.

As illustrated in FIG. 3, the first sewing station 40 includes a pair of sewing machines 115 and 116 located at opposite sides of the processing path. Sewing machines 115 and 116 operate to attach the elastic bands 20 and 21 to the cut head and foot edge portions 26 and 27 of the segment 35 of sheet material. The sewing machines 115 and 116 are Wilcox and Gibbs overedge machines with an elastic attachment. These are conventional in the art. The sewing machines 115 and 116 operate continuously during the operation of the fitted sheet hemmer 65, so that the bands 20 not only are attached to the head and foot edge portions of the segment of sheet material but also extend between adjacent segments. In normal operation it is expected that the gaps between adjacent segments of sheet material will be from 2 to 4 inches.

Figure 7:
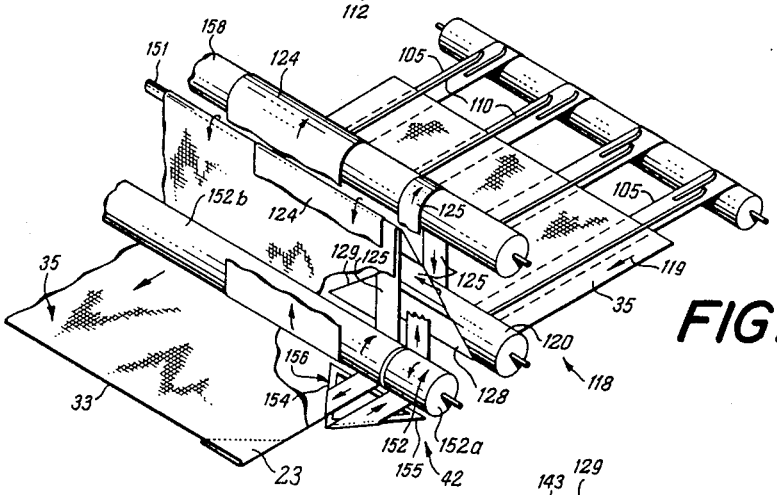
FIG. 7 is a perspective illustration of the folder, with parts broken away to illustrate the movement of the belts and of the segment of sheet material through the folder.
Figure 8:
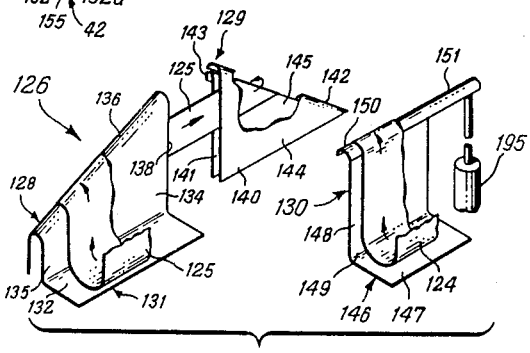
FIG. 8 is an exploded perspective illustration of an end portion of the folder, illustrating how the central feed belt and the side fold belts move through the folder.

FIGS. 7 and 8 illustrate the operation of one-half of the folder apparatus 118 which is positioned in the folding station 42. FIG. 7 illustrates the segment 35 of sheet material advancing in the direction of arrow 119 into the folder apparatus 118. The sheet material is carried by the surface conveyor tapes 105 and the stationary presser feet 110 until the leading edge of the sheet segment is introduced beneath the lower infeed roll 120 of the folder apparatus. Central feed belt 124 and side folder belts 125 on each side of the central feed belt (only one shown) move downwardly and then about infeed roll 120 and then in an upward direction. The 124 and 125 then pass about the fold plate assembly 126. The segment of sheet material is carried in unison with the belts, and the segment as well as the belts are driven in unison with the infeed roll 120.

Fold plate assembly 126 is partially illustrated in expanded format in FIG. 8. The fold plate assembly includes outer and inner bevel plate assemblies 128 and 129 positioned at the edge of that path of each segment of the sheet material. Central fold plate assembly 130 spans the gap between the bevel plate assemblies 128 and 129 at each side of the folder apparatus.

As previously stated, there is a pair of outer and inner bevel plate assemblies 128 and 129 located at opposite sides of the fold plate assembly. FIG. 8 illustrates only one of the pairs of outer and inner bevel plate assemblies. Outer bevel plate assembly 128 includes guide sheet 131 that has a horizontal span (132) and a vertical span 134 that is formed by the bend 135 in the guide sheet. Vertical span 134 includes an upper beveled bend 136 that is oriented at a 45 degree angle with respect to the vertical edge 138 of the guide sheet. The beveled bend 136 is an inverted U-shape and forms a rounded surface on which the side folder belt 125 can move.

Inner bevel plate assembly 129 includes a pair of beveled guide plates 140 and 141 that are of similar shape and which are closely spaced from each other. Each beveled guide plate 140 and 141 include an upper sloped bend 142 and 143 sloped at 45 degrees from vertical, with the bends extending from the vertical span 144 and 145, and with the bend 142 curving over the bend 143.

As illustrated in FIG. 8, central fold plate assembly 130 includes a guide sheet 146 that includes a horizontal span 147 and a vertical span 148, with an intermediate 90 degree bend 149. The upper end portion of vertical span 148 terminates in an inverted U-shape bend 150. A span bar 151 extends coextensively with upper bend 150 and extends across the folder apparatus to the other side of the processing path and joins to the guide sheet at the opposite central fold plate assembly.

Side folder belt 125 moves upwardly from infeed roll 120 and moves about the beveled bend 136 (FIG. 8) of the outer beveled plate assembly 128. Because of the 45 degree angle of the bend 136, the side folder belt 125 turns 90 degrees and begins a lateral movement from the outer bevel plate assembly 128 toward the inner bevel plate assembly 129. The side folder belt 125 enters the space between adjacent beveled guide plates 140 and 141 and then curves about the beveled bend 143 of the beveled guide plate 141. As the side folder belt moves about the beveled bend 143, it makes a 90 degree turn, beginning its downward movement from the inner bevel plate assembly toward the outfeed roll 152.

As illustrated in FIG. 7, when the side folder belt 125 moves about outfeed roll 152, it turns 90 degrees to a horizontal run and moves about the beveled edges 154 and 155 of the triangular shaped turning plate 156. This causes the side folder belt to pass through two 90 degree turns and to effectively make a U-turn and move back toward outfeed roll 152, turn 90 degrees about the outfeed roll to move upwardly and then through a U-shaped turn about upper return roll 158. The side folder belt then returns in a downward direction to the infeed roll. It will be noted that outfeed roll 152 is formed in segments, with end segments **152*a* rotating in one direction and central segment 152*b*** rotating in the opposite direction, so that the directions of rotation of the outfeed roll are compatible with the movements of the side folder belt.

Central feed belt 124 also moves downwardly and then about infeed roll 120 and picks up the main body portion 11 of the segment 35 of sheet material, moving the segment upwardly and then through a U-turn over the upper bend 150 of the guide sheet 146. The central feed belt then moves downwardly, then around the lower portion of outfeed roll 152 so as to make a U-turn and begin its upward run back over the upper return roll 158 and then back down to the infeed roll 120.

It will be noted from FIG. 7 that the central feed belt 124 causes the main body portion 11 of the segment of sheet material to move through an inverted U-shaped turn. In the meantime, the side folder belts 125 engage and move the head and foot edge portions of the segment, which eventually become the head and foot skirts 14 and 15 of the fitted sheet, and carry those portions of the segment first through the 90 degree position with respect to the segment, and then through a second 90 degree turn where the skirts are aligned with the main body portion of the segment 35. It will be noted that the side folder belts 125 are first applied to the top surface of the segment of sheet material and carry the head and foot edge portions into folded relationship with the main body portion 11 of the segment of sheet material, and then emerge from the folder beneath the segment of sheet material and are turned at 90 degrees to run out from beneath the segment of sheet material, and then make another 90 degree turn whereupon the return flight is aligned with the entrance flight.

Figure 10:
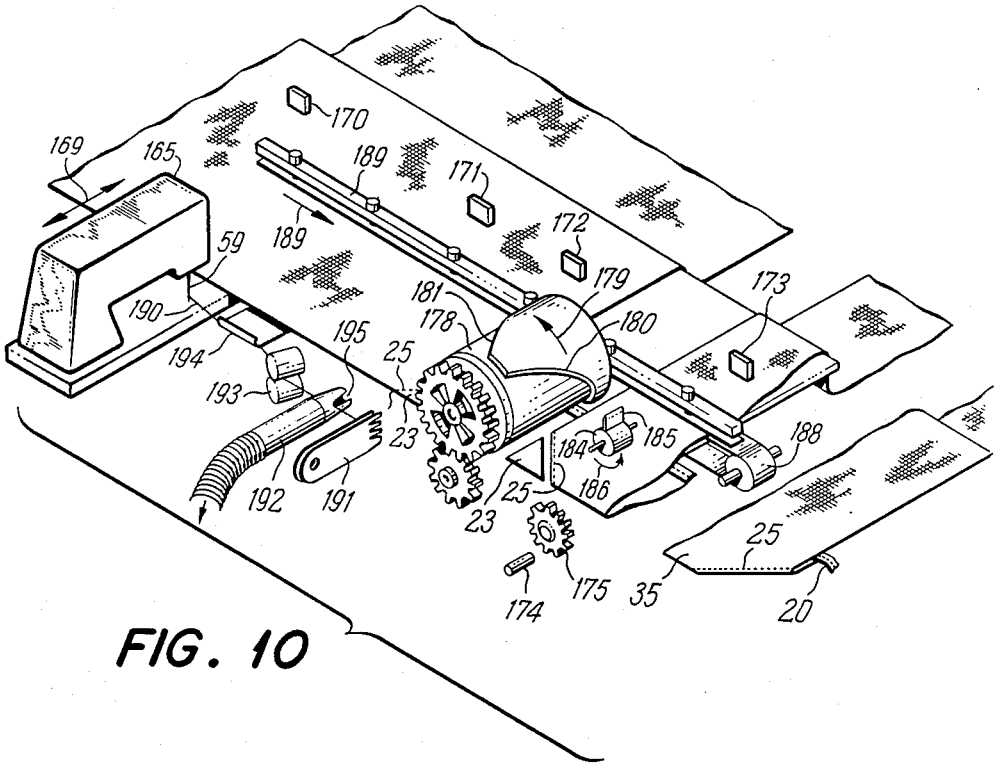
FIG. 10 is a schematic illustration of the cutters for the thread chain, elastic band and the spiral cutter for removing the triangular fold at the corners of the sheet as well as the controls for the shiftable sewing machines.

As illustrated in FIGS. 3 and 10, moveable sewing machines 164 and 165 are located on opposite sides of the processing path, with the sewing needles 58 and 59 located so as to sew the corner structures of the segments of sheet material. The sewing machines 164 and 165 are placed in slots, such as slot 166, in the work table, and a pneumatic cylinder (not shown) that is positioned beneath each sewing machine is arranged to move the sewing machines back and forth (as indicated by arrows 168 and 169) toward and away from the segments of sheet material being processed through the fitted sheet hemmer. A control system, including photo cells 170 and 171 (FIG. 10), is used to control the movements of the sewing machines 164 and 165. When photo cell 170 detects the on-coming leading edge of a segment of sheet material the sewing machines 164 and 165 are both moved outwardly toward the outer edge of the processing path whereupon a diagonal line of chain stitching 25 is formed at the trailing corners of the segment of the bedsheet. The combined inward movement of the sewing machines 164 and 165 together with the progressive movement of the segment of sheet material results in the diagonal line of stitching 25 formed at the leading corners of the segment of sheet material. The detection by photo cell 170 of the leading edge of the segment of sheet material also activates counter 174 (FIG. 10) which counts the movement of teeth on a gear 175 of the conveyor drive system. When the photo cell 171 detects the trailing edge of a segment of sheet material, cutter drum 178 is rotated in the direction as indicated by arrow 179, and its spiral cutting rib 180, which works against a cylindrical cutting surface (not shown) is rotated so as to engage and cut a segment of sheet material 35, to remove the triangular cutout 23 (FIG. 10) adjacent the line of stitching 25 formed by the sewing machine. A spiral cutting drum 178 is located on each side of the machine at the edge of the path of travel of the segments of sheet material.

The cutting drum 178 rotates only 180 degrees in response to the signal received from photo cell 171.

When photo cell 172 detects the on-coming edge of a segment of sheet material 35, the cutter drum is activated again and rotates another 180 degrees in the direction as indicated by arrow 179, and its other spiral cutting rib engages and cuts the corner of the on-coming segment, to remove the triangular cutout 23 adjacent the line of chain stitching 25.

When photo cell 173 detects the trailing edge of a segment of sheet material 35, it activates a pair of rotary cutters 184, so that the cutting blade revolves 360 degrees in the direction as indicated by arrow 186 and works against a similar backing drum (not shown). The cutting blade 185 engages and cuts the elastic band 20 in the gap between adjacent segments of sheet material. In the meantime, surface conveyor tapes 188 are driven by the conveyor drive system (not shown) along the work table and a presser ski assembly 189 urges the segments of sheet material into frictional engagement with the conveyor tapes so that the segments are moved in unison with the conveyor tapes.

When the photo cell 174 has counted a predetermined number of the teeth of a gear 175 of the conveyor system, the segments of sheet material will have moved a predetermined distance. When the count has been completed, the sewing machines 164 and 165 will be moved inwardly from adjacent the processing path into sewing engagement with the segment of sheet material so as to begin the sewing of the diagonal line of chain stitching 25 at the corners of the trailing edge of the segment of sheet material. This causes the lines of stitching at the corners of the segments of sheet material to be a certain distances apart without regard to the length of the segment of sheet material. Therefore, if the segments of sheet material that are supplied to the system are slightly too long or slightly too short, the fitted bed sheet formed by the system will be accurately formed to fit the standard mattress.

The sewing machines 164 and 165 can be operated continuously, if desired. The thread chain 190 (FIG. 10) from the sewing machine runs off the segment of sheet material when the sewing machines are moved outwardly with respect to the processing path. It is desirable to cut thread chains 190 when the thread chains run off the segments of sheet material. For this purpose, oscillating cutters 191, vacuum conduit 192, guide rolls 193 and guide plate 194 are placed at the side edges of the processing path downstream of the sewing machines 164 and 165. As the segment of sheet material moves through the system and when the sewing machines run off the edges of the segment of sheet material, the thread chain 190 will be guided by guide plate 194 toward guide rolls 193. Guide rolls 193 are angled so that as they rotate and pass the thread chain therebetween, they also move the thread chain laterally away from the processing path and into the slot 195 at the inlet of the vacuum conduit 192. The thread chain is then further drawn by the segment of sheet material toward the oscillating cutters 191, where the thread chain is cut. When the thread chain has been cut by the oscillating cutters 191, the vacuum conduit 192 draws the now free end of the thread chain into the vacuum conduit, where the thread chain moves toward a collection area. In the meantime, the sewing machines continue to operate and the thread chain formed from the sewing machines are carried to the vacuum conduits until the sewing machine moves back into sewing engagement with the segment of sheet material. As the line of stitching 25 now being formed by the sewing machine passes the vacuum conduit 192 and oscillating cutters 191, the oscillating cutters 191 will again cut the protruding end portion of the thread chain 190 so that the previously collected length of thread chain in vacuum conduit 192 will not be pulled out of the conduit and carried away with the segment of sheet material.

After the segments of sheet material have been separated by the rotary cutters 184 cutting through the elastic bands 20, the sheets are completed and can be everted so as to be right side out and ready for folding, packaging and delivery to the retail store.

As illustrated in FIG. 8, the span or bar 151 that forms the curved surface of the U-turn about which the main body portion 11 of the segment passes has mounted thereto one or more fluid actuated cylinders 194 which are arranged to raise and lower the bar 151. In the meantime, the outer bevel plate assembly 128 and inner bevel plate assembly 129 on opposite sides of the bar 151 remain stationary.

Figure 9:
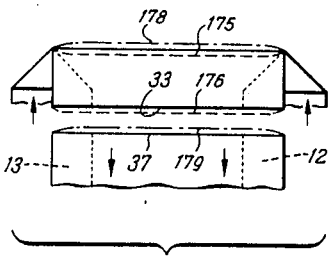
FIG. 9 is a schematic illustration of adjacent segments of sheet material, showing how the adjustments of the length of the U-turn traversed by the central portion of the segments of sheet material changes the alignment of the trailing and leading edges of the central portion and side skirts of the segments.

As illustrated in FIG. 9, the raising and lowering of the guide bar 151 tends to lengthen or shorten the length of the U-turn about which the central span or main body portion 11 of the sheet material passes. As shown in FIG. 9, when the guide bar 151 is lowered from the solid line position to the dash line position 175, the central span of the segment travels a shorter distance, and its leading edge 33 advances from the solid line position to the dash line position 176. Thus, when the guide bar 151 is lowered so as to shorten the length of the U-turn, the leading edge 33 for the central body portion will move further than the leading edges of the head and foot edge portions, so that the central span of the segment will extend beyond the leading edges of the folded side skirts 12 and 13 and the head and foot leading edge portions will not hang out and form misaligned edges.

Likewise, when the fluid actuated cylinder 194 (FIG. 8) raises the U-shaped guide bar 151 to the dot and dash line position 178 (FIG. 9), the length of the U-turn is increased. This will cause the trailing edge 37 of a segment of sheet material to be repositioned from the full line position to the dot and dash line position 179, causing the trailing edge to extend beyond the trailing edges of the side skirts 12 and 13.

A photo cell (not shown) or other control mechanism will be utilized to determine the positions of the leading and trailing edges of the segments of sheet material passing through the folder. The position of the guide bar as controlled by the fluid actuated cylinder 194 is adjusted just before a trailing edge 37 begins its movement about the U-shaped guide 151. Just as the trailing edge 37 approaches the U-shaped guide, the U-shaped guide is raised so as to lengthen the U-shape, thereby tending to retard the movement of the trailing edge 37 of the central portion of the segment of the sheet material with respect to the trailing edges of the side skirts 12 and 13.

Just after the trailing edge 37 passes over the U-shaped bar 151 and the on-coming leading edge 33 of the next following segment of sheet material is about to move over the U-shaped guide bar, the U-shaped guide bar is lowered so as to shorten the length of the U-turn. This causes the on-coming leading edge 33 to be advanced with respect to the side skirts 12 and 13, causing the leading edge 33 of the central portion of the segment to extend beyond the leading edges of the side skirts. As previously described, this avoids the presence of a mismatch effect where the leading edges and trailing edges of the side skirts might extend out beyond the leading or trailing edges of the central portion of the segment of sheet material.

The central feed belt 124 (FIG. 7) tends to stretch and contract during the raising and lowering of the central guide 151. Although not specifically illustrated herein, a tension roll can be added to the central feed belt so as to compensate for the raising and lowering of the central feed belt, as may be necessary.

The invention has been described as applying the elastic bands 21 to the head and foot skirts 14 and 15; however, it will be understood that fitted sheets can be cut and sewn so that cut segments of sheet material are moved parallel to their side edges instead of the end edges and the elastic bands are applied to the side skirts instead of the head and foot skirts. Therefore, the terms "head and foot edge portions" and similar references to the head and foot of the product generally refer to the edges of the segments of sheet material that extend parallel to the processing path through the sewing machines and the "side edges" and similar references to the sides of the product refer to the edges of the segments of sheet material that extend at a right angle to the processing path.

Although the invention has been described in the preferred embodiment, modifications, additions, and deletions may be made thereto without departing from the spirit and scope of the invention as set forth in the claims.

I claim:

1. In a hemming apparatus in which flexible segments of sheet material are advanced along their lengths in series along a processing path, folded and sewn, the improvement therein of a folder for folding the segments of the sheet material as the segments are moved in series along the processing path, said folder comprising:

U-turn guide means for moving the central body portion of the segment through a U-turn;

first beveled turning means adjacent opposite sides of said U-turn guide means for turning each of the opposite end edges of the segment through a right angle turn inwardly onto the adjacent portion of the central body portion of the segment as the central body portion approaches the U-turn, second beveled turning means adjacent opposite sides of said U-turn guide means for turning each of the opposite end edges of the segment through a second right-- angle- turn into overlying relationship with respect to the adjacent portion of the central body portion as the central body portion approaches the U-turn, and side folder belts movable through each of said first and second beveled turning means at opposite sides of the U-turn guide to carry the opposite end edges of the segments about the first and second beveled turning means.

2. The apparatus of claim 1 and wherein said U-turn guide means includes means for changing the length of the U-turn with respect to the lengths of the two right angle turns whereby the alignment of the leading and trailing edges of the central body portion with respect to the leading and trailing edges of the opposite end edges can be adjusted.

* * * * *